United States Patent [19]

Ball et al.

[11] 4,393,979

[45] Jul. 19, 1983

[54] CLOSURES FOR CONTAINERS

[75] Inventors: Martin F. Ball, Shrivenham; Fred Fidler, South Morton, Nr. Didcot, both of England

[73] Assignee: Metal Box Limited, Reading, England

[21] Appl. No.: 253,365

[22] Filed: Apr. 13, 1981

[30] Foreign Application Priority Data

Apr. 15, 1980 [GB] United Kingdom ..... 8012372

[51] Int. Cl.[3] ..... B65D 17/34

[52] U.S. Cl. ..... 220/270; 220/DIG. 19; 220/307

[58] Field of Search ..... 220/265, 260, 270, 307, 220/DIG. 19

[56] References Cited

U.S. PATENT DOCUMENTS 3,434,620 3/1969 Laurizio ..... 220/270

3,910,453 10/1975 Kneusel et al. ..... 220/307 X 4,024,980 5/1977 Kneusel et al. ..... 220/260

*Primary Examiner*—George T. Hall

*Attorney, Agent, or Firm*—Diller, Ramik & Wight

[57] ABSTRACT

A closure for an aperture in a container wall having an annulus of gasket material around the aperture, has a plug portion and a peripheral flange extending axially and outwardly of the plug portion to terminate in a feather edge adapted to engage the gasket material when the plug portion is inserted in the aperture.

In order to seal the aperture, the gasket material applied to the wall to surround the aperture and the plug portion of the closure is force fitted into the aperture to hold the feather edge of the flange in sealing engagement with the gasket material.

The closure may be used to close cans of beverages and permit easy access to the contents by pushing the plug portion into the can.

3 Claims, 6 Drawing Figures

CLOSURES FOR CONTAINERS

This invention relates to closures for an aperture in a wall of a container and more particularly but not exclusively to a method of sealing an aperture in a can end.

Beverage cans having easy opening ends are known in which the central panel of the can end has a pair of openable portions which are pressed into the can to give access to the contents. In one known can each openable portion is created by stretching up from the can end a dome of material, the dome of material is then cut from the rest of the panel by an arcuate cut which leaves a hinge portion to connect the dome to the panel. The dome is then flattened so that its periphery spreads to span the inside of the aperture cut so that the flattened dome is an openable portion which cannot come out through the aperture because it is too large; it can however be easily pushed inwards to open the aperture. Such openable portions are sealed in the closed position by applying a sealing compound over the cut edges. The manufacture of these can ends requires careful control of tooling, presses and the application of sealant.

Other can ends are known in which a simple aperture in the can end is closed by a flanged rubber bung as described in British Patent Specification No. 1,404,602. However the flange is located on the inside of such cans, so again the closure or bung cannot come out of the can. Difficulty can arise when the cans are thermally processed because the rubber bungs may harden or perish. If the bungs are too soft they may be unable to withstand the internal pressures in the can. Therefore the problem is how to sealingly engage a relatively hard plug of plastics material with a rigidly defined aperture in a container wall. This invention provides a container having a wall, an aperture in the wall, at least an annulus of gasket material around the aperture on the inside of the container, and a plug closure having a plug portion in the aperture and a deformable flange extending axially and outwardly of the plug wall to surround the plug portion and terminate in an edge engaged with the gasket material.

The plug closure may be made of a plastics material such as nylon or polypropylene. The plug portion may be frictionally engaged with the aperture.

In one embodiment the flange terminates in a feather edge held in sealing engagement with the gasket by frictional engagement of the plug portion in the aperture.

The aperture may be defined by an annular flange extending from the plane of the wall towards the flange of the closure.

In a further embodiment the plug portion is hollow and closed by an end wall, the end wall including a line of weakness defining an openable portion. The openable portion may be provided with a pull ring to facilitate opening.

The invention further provides a method of closing an aperture in a wall of a container using a closure having a plug portion and a peripheral flange extending axially and outwardly of the plug portion to surround the plug portion and terminate in an edge, said method comprising the steps of providing a wall having an aperture therein surrounded by at least an annulus of gasket material on the inside side of the wall and force fitting the plug portion of the closure into the aperture to hold the feather edge of the flange in sealing engagement with the gasket material. The gasket material may be applied as a fluid lining compound and cured before the closure is fitted. Alternatively the lining compound may be applied by screen printing onto the wall.

In an alternative method the gasket material is applied to the wall as a film of plastics material which may if desired, be applied to the wall before the aperture is made. The gasket in the form of lining compound may also be applied to the wall before the aperture is made.

Various embodiments of the invention will now be described by way of example and with reference to the accompanying drawings in which.

Figure 1:
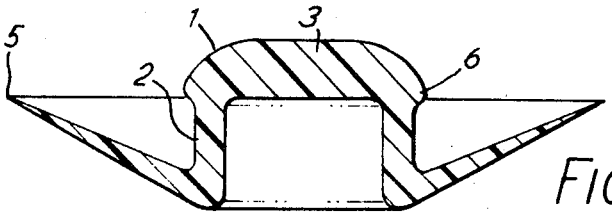
FIG. 1 is a side elevation of a first embodiment in which the closure is sectioned on a diameter.

In FIG. 1 the closure 1 has an annular plug wall portion 2 closed by an end wall 3 at one end and having at the other end a resiliently deformable flange 4 extending axially and outwardly of the plug wall portion 2 to surround the plug wall portion and terminate at a peripheral edge 5 adapted to engage an annulus 9 of gasket material around an aperture in a wall into which the closure is inserted.

As shown in FIG. 1 the plug wall portion has a bulbous bead 6, adjacent the end wall 3, which serves to retain a plug wall portion of a soft plastics material in an aperture. If however the plug wall is made of a very stiff plastics material this bulbous bead 6 may be too stiff to permit pushing of the plug wall portion through the aperture and so the bulbous periphery is not always desirable.

As shown the flange 4 tapers in thickness from the plug wall portion 2 to the edge 5 so that the peripheral margin adjacent the edge 5 is inherently more flexible than the flange material nearer the plug wall portion 2.

Figure 2:
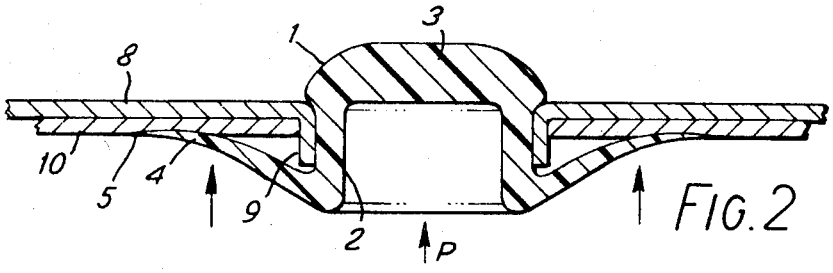
FIG. 2 is a side elevation of the closure of FIG. 1 when engaged in an aperture in a wall in a first mode.

In FIG. 2 a closure 1 is shown fitted in an aperture 7 in a container wall 8. The aperture is defined by an annular wall 9 extending from the wall 8. Had the wall 8 been thicker the annular wall 9 would not have been essential. An annulus 10 of resilient gasket material surrounds the annular wall. As shown in FIG. 2 the domed top of the end wall 3 of the plug wall portion 2 stands proud of the side of the wall while the feather edge 5 of the flange 4 engages the annulus 10 of gasket material on the other side of the wall, the frictional engagement of the plug wall 7 with the annular wall 4 serving to maintain this arrangement.

It will be noticed that the flexible flange 4 has bent to a generally curved shape engaged over an annular area of the gasket material.

It will be understood that if a pressurised fluid "P" denoted by arrows acts upon the flexible flange 4 the edge will be forced in a first mode of sealing engagement, in which the gasket material is compressed by the flange as shown in FIG. 2.

Figure 3:
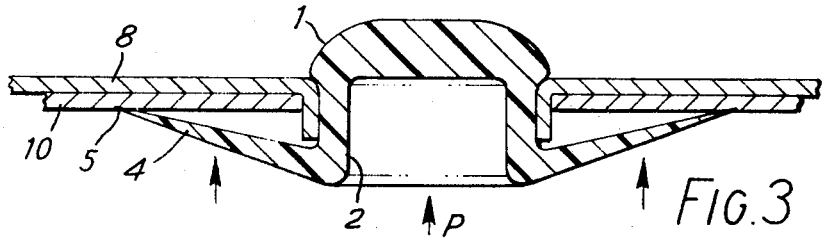
FIG. 3 is a side elevation of the closure of FIG. 1 when engaged in an aperture in a wall in a second mode.

In FIG. 3 the closure 1 has been moulded from a stiff plastics material such as nylon so that in spite of the internal pressure denoted "P" the flange 4A has remained straight like a buttress but resiliently pivoted in relation to the plug wall 2 so that the peripheral edge 5 compresses the surface of the annulus 10 of gasket material to form a second mode of sealing substantially in the form of a line of seal.

It will be understood that in each mode of sealing as described with reference to FIG. 2 and FIG. 3 the primary seal is achieved by force fitting the plug portion 2 in the aperture to pull the flange (4,4A) into sealing engagement with the annulus 10 of gasket material. The sealing force arising from the pressure P upon the flange (4,4A) is additional to the primary seal.

Figure 4:
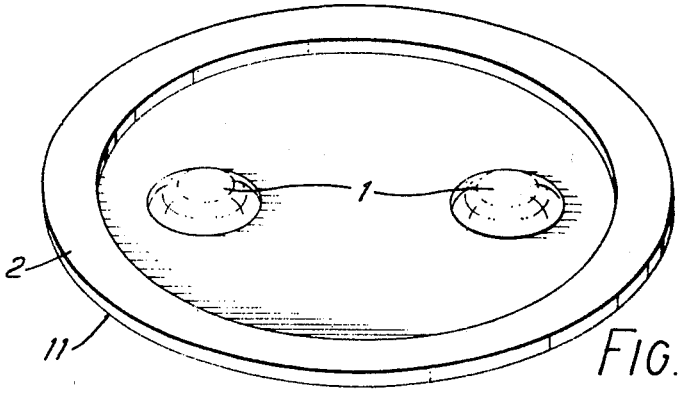
FIG. 4 is a perspective view of the outside of a can end fitted with two of the closures shown in FIG. 1.

FIG. 4 shows a can end suitable for a can for carbonated beverages; in cross-section each closure 1 in the can end 11 would look like the closure shown in FIG. 1. Such a can end may be made from tinplate and the cut free edge of the annular wall 9 is liable to rust. However when the closure 1 is fitted as shown in FIG. 1 the cut edge is protected from the external environment by the tight fit of the plug wall 2 in the annular wall 9 and furthermore protected, from the corrosive influence of a carbonated beverage within a can to which it is fitted, by the sealing engagement of the edge 5 with the annulus 10 of gasket material.

Two closures 1 are provided in the can end 11 so that when both closures are opened one aperture may be used for pouring while the other permits venting of the can.

The can end may be stamped from any one of a variety of sheet metal such as tinplate, aluminium or chromium/chromium oxide coated steels. If however the can end is stamped from a laminate of sheet metal and a plastics film then a separately applied gasket need not be provided. The range of suitable laminates includes polyethylene film on tinplate or aluminium and copolymers of ethylene and partly neutralised acrylic acid on tinplate or chromium/chromium oxide coatings on steel.

As already explained, the plastics material of the closure is of necessity relatively rigid so that the preferred plastics material is a nylon such as Nylon 66 or Nylon 12. However other plastics materials such as polypropylene may suffice.

When the gasket is applied as a fluid known can end lining compounds in the form of organosols or plastisols are quite suitable. Whilst the compound may be applied from a fixed nozzle under which the can end is rotated it is preferable to use a screen printing process so that an even thickness of deposit is achieved. As most can ends have a lining compound applied to the peripheral cover hook (denoted 12 in FIG. 2) it is convenient to cure the cover hook lining compound and annular gasket material at the same time, especially if they are both of the same material. As screen printing permits precise location of the gasket material the aperture in the can end may be formed either before or after the gasket material has been applied to the can end.

Once the can end having an aperture surrounded by at least an annulus of gasket material is provided, the plug portion of the closure may be force fitted into the aperture to hold the feather edge 9 of the flange in sealing engagement with the annulus 5 of lining compound or other gasket material.

To open the closure 1 described with reference to FIGS. 1 to 4 the user presses down on the central panel pushing the closure into the can.

Figure 5:
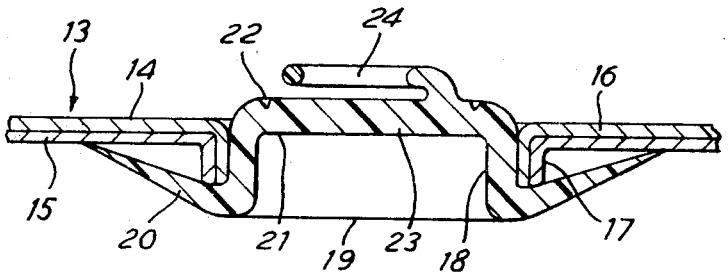
FIG. 5 is a sectioned side elevation of a second embodiment in which the closure is sectioned on a diameter.
Figure 6:
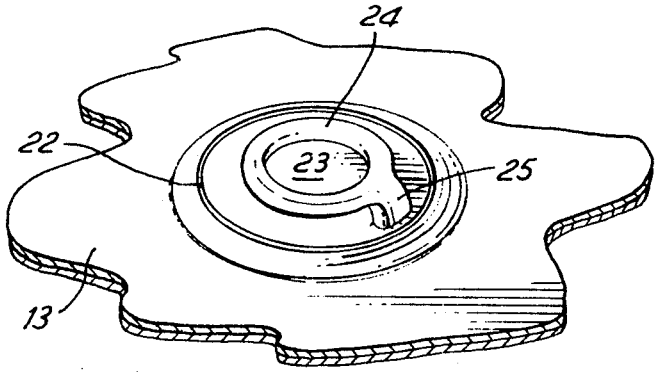
FIG. 6 is a perspective view of the closure and wall of FIG. 5.

In contrast, FIGS. 5 and 6 show a plug closure adapted to be opened by pulling open the end wall of the plug so that there is no risk of the potentially dirty exterior of the plug contaminating the contents of the container.

FIG. 5 shows a fragment of a container wall 13 such as a can end, formed from a sheet of laminate of sheet metal 14 such as tinplate or aluminium and a plastics material 15 such as polyethylene film. The plastics material 15 is on the inside of the container to resist the corrosive influence of the contents of the container.

The container wall 13 comprises a planar portion 16 and an annular flange 17 which defines an aperture in which a plug portion 18 of plug closure 19 is a push fit.

The plug closure 19 has a flange 20 the periphery of which seals against the plastics material 15 in the manner already described with reference to FIGS. 1 to 4. The plug portion 18 is closed by an end wall 21 having a circular line of weakness 22 which defines a removable central portion 23 as can be seen in FIG. 6. A pull ring 24 is moulded integrally with a strap portion 25 connecting with the central portion 23 to provide means for pulling the central portion 23 from the plug portion 18 by breaking the circular line of weakness 22.

To open the closure of FIGS. 5 and 6 the user pulls upon the pull ring 24 to break the line of weakness 22 and this opens the end wall 21. The plug portion 18, being a friction fit in the annular flange 17, is not moved and so the potentially dirty surfaces of the plug portion 17 and opened end wall 21 do not enter the can. If desired, the line of weakness need not be a complete circle so that an unweakened hinge portion provides a hinge to render the removable portion captive.

The plug closure of FIGS. 5 and 6 may if desired be used in conjunction with a gasket of lining compound as already described with reference to FIGS. 1 to 4. Alternatively the plug closures of FIGS. 1 to 4 may if desired be used in conjunction with the laminate container wall of FIGS. 5 and 6.

We claim:

1. A container having a wall, an aperture in the wall, an annulus of gasket material around the aperture on the inside of the container wall and a plug closure including a plug portion, said plug portion including a cylindrical wall and an end wall, said cylindrical wall being disposed in said aperture, said plug closure being constructed from relatively rigid and stiff synthetic copolymeric plastic material, a flange extending generally radially outwardly of the cylindrical wall to surroundingly underlie an annular wall portion of said container wall, said flange being radially outwardly converging in axial cross-section to thereby define a deformable feather edge, said feather edge terminating in a terminal edge held in formed sealing engagement with the gasket by frictional engagement of the cylindrical wall in said aperture.

2. The container as defined in claim 1 including a line of weakness in said end wall defining an openable portion thereof.

3. The container as defined in claim 2 including a pull ring attached to said openable portion.

* * * * *